United States Patent [19]

Badoz et al.

[11] 4,231,632

[45] Nov. 4, 1980

[54] CONTACT ELEMENT FOR INSULATION PIERCE TYPE

[75] Inventors: Jean-Marie Badoz; Daniel Merceron, both of Suresnes, France

[73] Assignees: Socapex, Suresnes; Souriau et Cie, Boulogne, both of France

[21] Appl. No.: 970,854

[22] Filed: Dec. 18, 1978

[30] Foreign Application Priority Data

Dec. 22, 1977 [FR] France ..... 77 38829

[51] Int. Cl.[3] ..... H01R 4/02

[52] U.S. Cl. ..... 339/97 R; 339/176 R; 339/223 R

[58] Field of Search ..... 339/97 R, 97 C, 97 L, 339/95 R, 96, 98, 223, 176 R, 176 M

[56] References Cited

U.S. PATENT DOCUMENTS

| | | | |
|---|---|---|---|
| 2,583,530 | 1/1952 | Hasselbohm | 339/95 R |
| 2,938,190 | 5/1960 | Krehbiel | 339/176 M |
| 3,622,955 | 11/1971 | Fernex | 339/223 R |
| 4,050,760 | 9/1977 | Cohen | 339/223 R X |
| 4,114,975 | 9/1978 | Weidler | 339/96 X |

*Primary Examiner*—Howard N. Goldberg
*Assistant Examiner*—DeWalden W. Jones
*Attorney, Agent, or Firm*—Cushman, Darby & Cushman

[57] ABSTRACT

A contact element to be supported in the insulating block of a connector provided at its rear portion (18), with piercing and anchoring slots (30), and (31), located on a parallelepiped structure with three folds (20), (21), (22), closed by a tenon (26) and a slot (27).

7 Claims, 7 Drawing Figures

Figures 1A, 1B, 2:
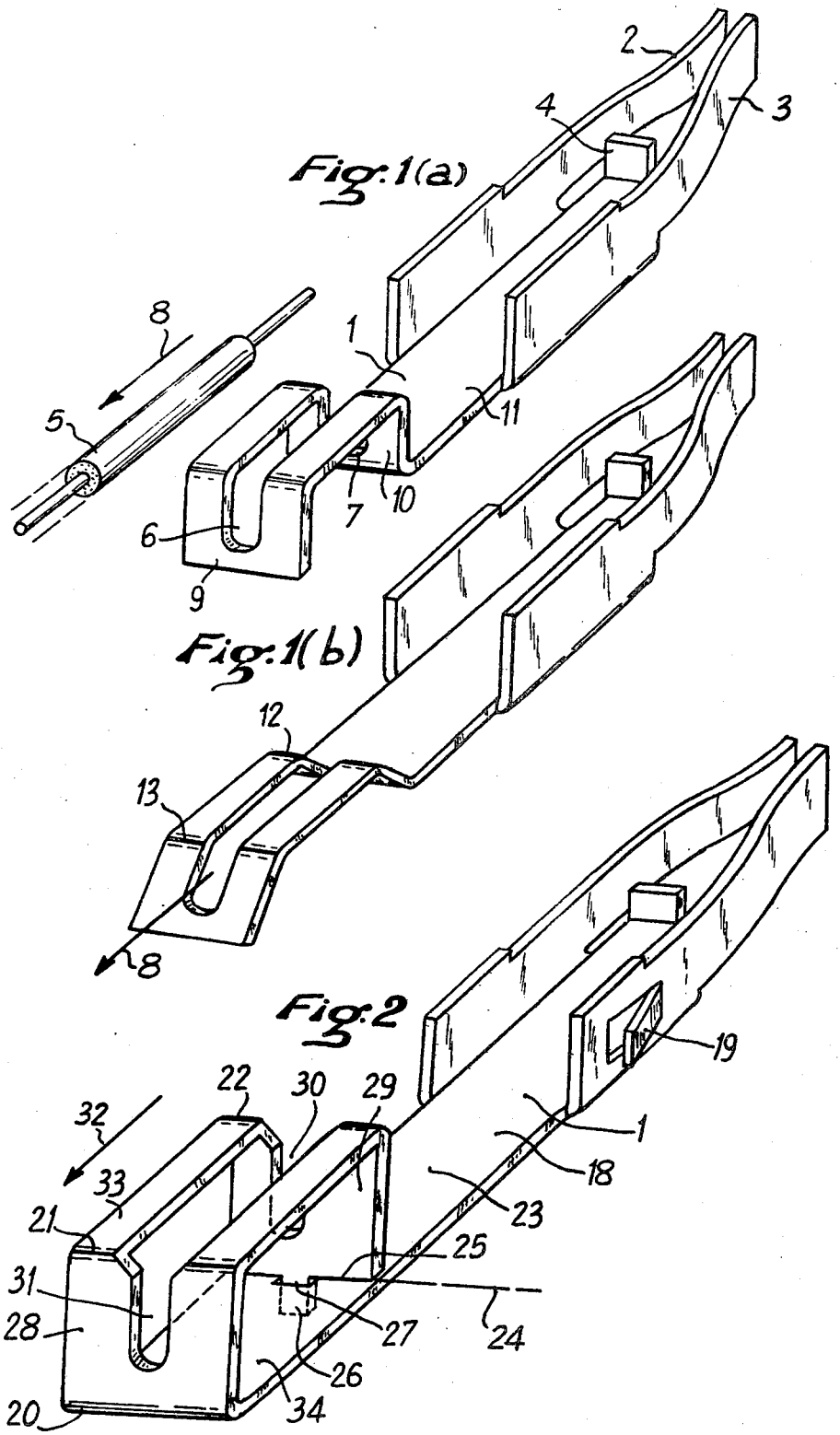

1
2
3
4
5
6
7
8
9
10
11
12
13
18
19
20
21
22
23
24
25
26
27
28
29
30
31
32
33
34

CONTACT ELEMENT FOR INSULATION PIERCE TYPE

The present invention relates to the field of electrical connectors for connecting circuits whose ends for connection are in the form of conductor wires. The connectors used comprise, in this case, contact elements fixed in an insulating block, these contact elements having to be connected to said wires. One of the important industrial features of these devices is the rapidity and the low cost of such connections. Said connections, which are most often obtained by thermal soldering onto a soldering "lug" or by "wrapping" about a wrapping lug, are increasingly being obtained now by simple clamping or pinching in an open U or V-shaped slot located on one portion of the contact.

Clamping of the conductive part of the wire, ensuring electrical connection properly speaking, can be accompanied by clamping in a second open slot, the insulating sheath, if any, covering the wire thus ensuring the mechanical anchoring of the wire and, consequently, protecting the electrical connection from any longitudinal mechanical forces that may be set up as a result of accidentally pulling on the wire. In addition, according to certain known variants, the edges of the clamping slots comprise portions that are fined down to form cutting blades which, when the sheathed wire is introduced into the slots, cut through the insulating sheath and bring the internal conductor wire into direct contact with the contact element having these slots. This is the important feature of the "insulation pierce type connection."

Finally, it has sometimes been found useful to consolidate the connection, once it has been made, to protect it from the risks in service conditions that are bound up with vibrations or twisting of the wire.

The prejudicial forces can, in fact, result in the wire's being pulled out of the of the slot and, consequently, the connection is interrupted. Those means that have been proposed most often comprise flexible or deformable parts forming part of the contact element and the presence of which tends to prevent the wire in place from being extracted.

However, the increasing trend towards miniaturisation of components, promoted in particular by the need to increase the number of said components per unit of volume, has led to the use of increasingly thinner sheet for the industrial scale manufacture of contact elements, which are usually produced by cutting out and folding them from sheet metal.

This results in a harmful reduction in the practical features of mechanical strength of said contact elements, particularly when tensile forces are applied, either under normal conditions or accidentally, to the wires that are connected thereto. The contact elements are increasingly found to become damaged or even destroyed, either through partial or total unbending of certain parts formed by bending, or even by deformation or twisting of the element itself as a whole.

The present invention relates to an insulation pierce type contact that has none of these drawbacks. To achieve this, that part of the element that is to provide the connection with the wire of the circuit is designed by folding it to form a parallepiped the folded edges of which are normal to the direction in which the tensile forces are applied to the wires and two of whose opposite faces carry respectively insulation piercing, and anchoring slots. Any accidental traction on an already connected wire would thus require the simultaneous modification of four angles of a parallelogram, three of which are defined by mechanically robust folding, with the length of the four sides being invariable. Such a structure thus guarantees maximum resistance to accidental unbending or deformation.

In addition, according to another advantageous feature of the invention, the parallelepiped according to the invention, one of the forms of embodiment of which is a rectangular parallelepiped, can be an oblique parallelepiped, the two inclined faces being those that have the piercing and anchoring grooves, the open entries of the latter being turned in the direction opposed to that of any accidental tensile forces.

According to the invention, it is provided a contact element for an insulation pierce-type connector, for a wire covered by an insulating sheath, comprising a front portion ensuring this contact with an additional contact element belonging to another circuit, and a rear portion providing the connection with the wire, this part comprising open grooves, wherein said piercing and connection are achieved by introducing the wire, said rear portion having the longitudinal shape of a bent strip, comprising longitudinally three folds in the same direction, forming two pairs of faces of a parallelepiped, whereof one of these pairs constitutes said transverse walls.

Figure 3:
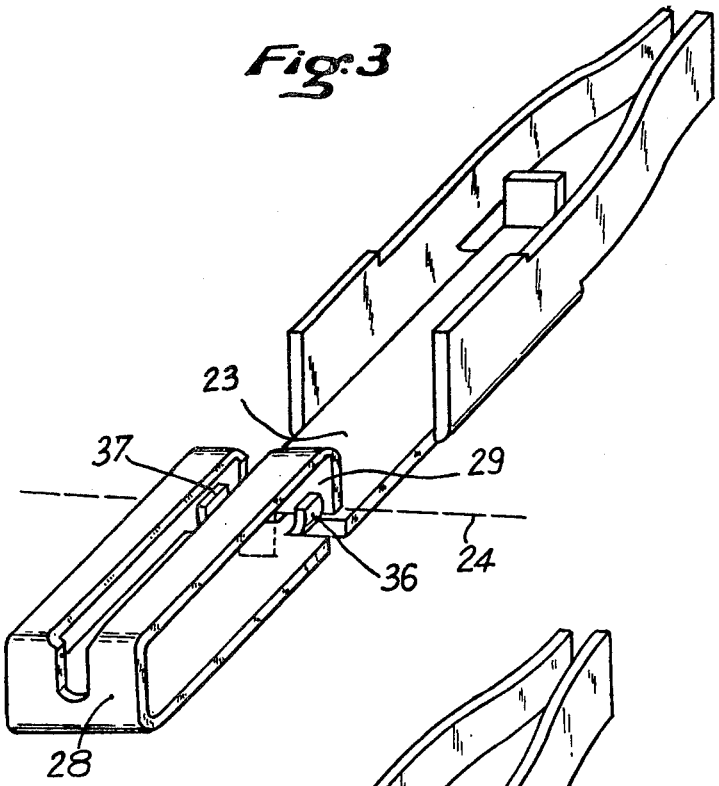
Figure 4:
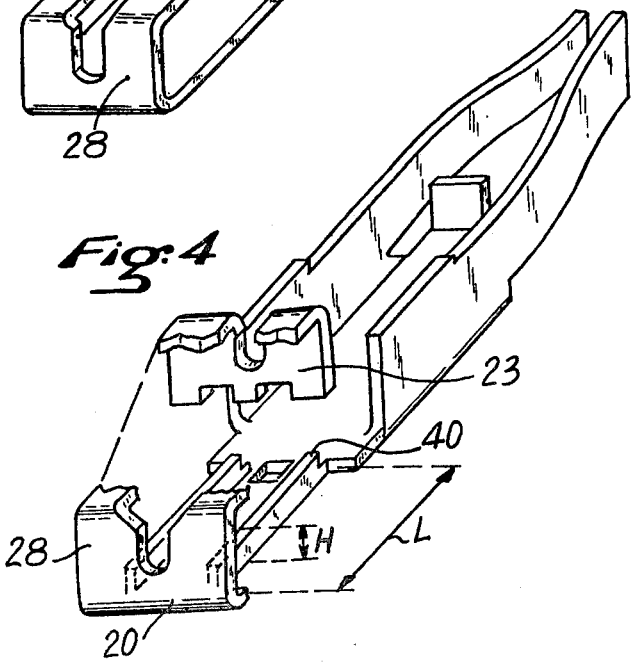
Figure 5:
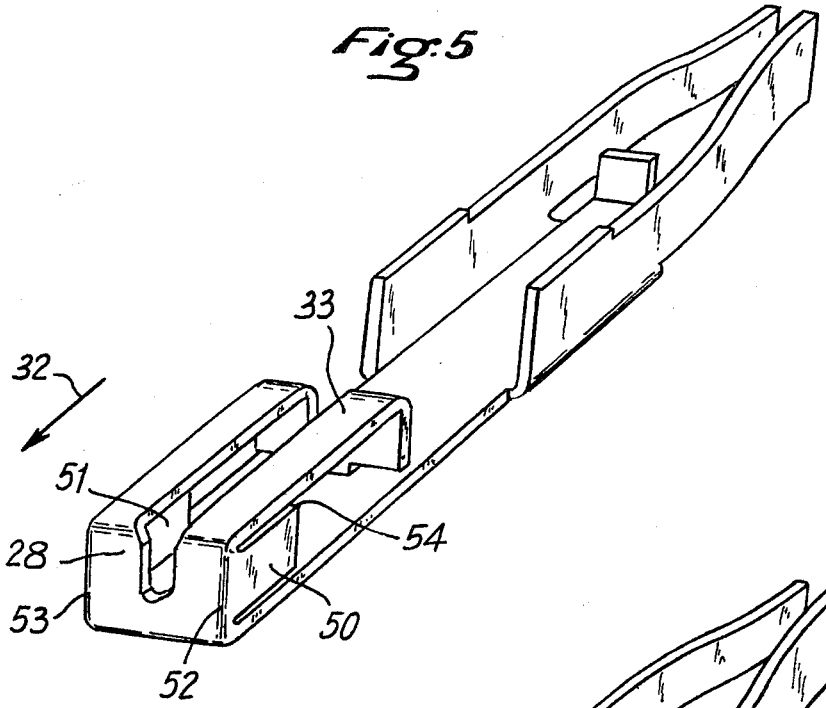
Figure 6:
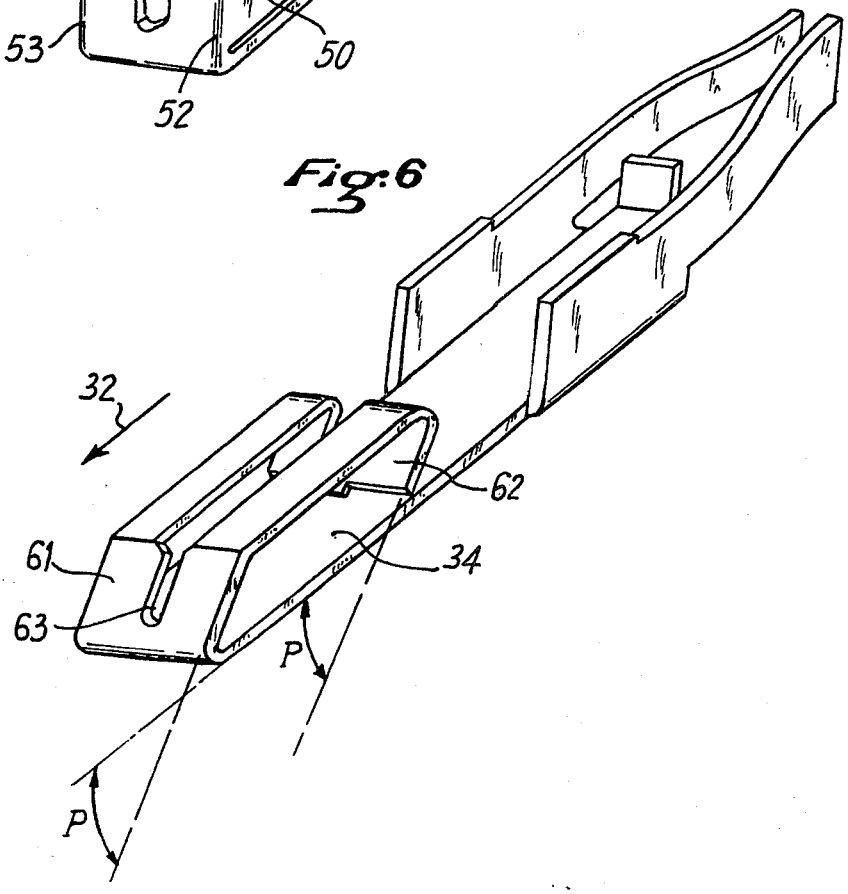
Figure 7:
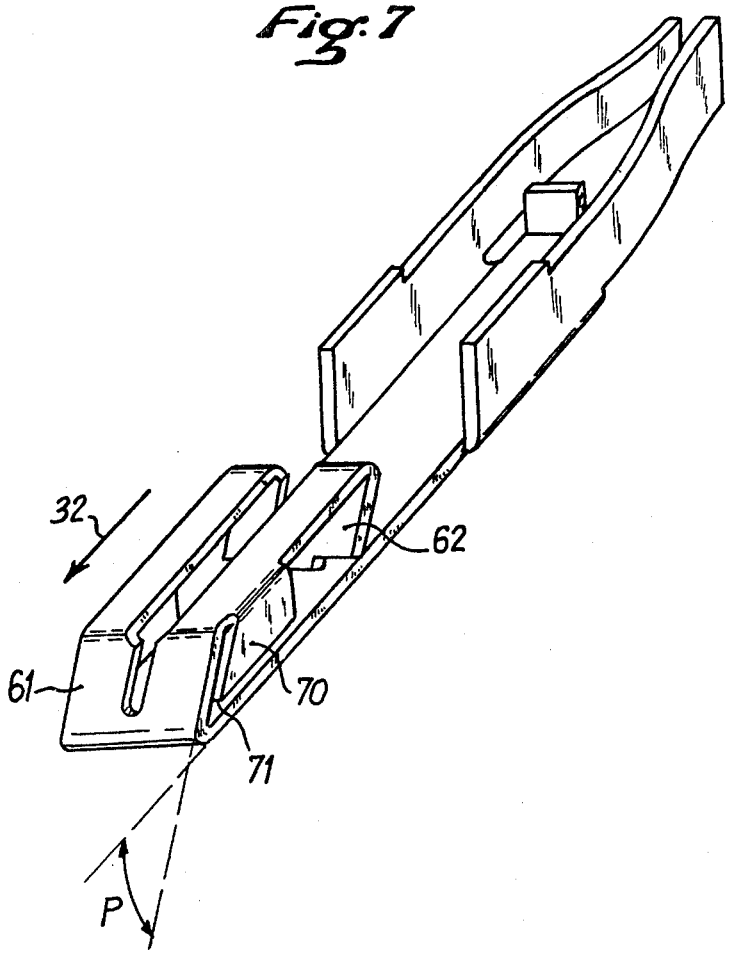

The present invention will be more readily understood by means of the description herebelow with reference to the attached figures wherein:

FIG. 1(*a*) and FIG. 1(*b*) represent an insulation pierce type contact element according to the known art, FIG. 2 represents a contact element according to the invention, FIGS. 3, 4 and 5 represent alternative forms of embodiment of this element in the form of a rectangular parallelepiped, FIGS. 6 and 7 represent alternative forms of embodiment of this element in the form of an oblique parallelepiped.

FIGS. 1(*a*) and 1(*b*) represent a contact element of the insulation pierce type, according to the known art. It includes a front portion 1 providing clamping contact, by its flexible parts 2 and 3, with a complementary contact element, not represented, that is inserted between them, and whose penetration is limited by the stop 4, and a rear portion providing connection with a sheathed wire 5. Connection is achieved by introducing the wire into slots 6 and 7, the edges of one of which, 7, cuts the insulating sheath and causes electrical contact with the conductor wire, and the other of which, 6, clamps or pinches the sheath of the wire, ensuring its longitudinal attachment or anchoring, resisting the mechanical forces, tensile forces for example, that are accidentally applied to the wire 5, in the direction of the arrow 8. In the known art, these slots are located on walls 9 and 10 obtained by folding a plane strip 11. However, this type of structure has a serious disadvantage if the dimensions of the contact element have to be reduced below a certain scale for practical applications. In fact, for certain tensile forces, the thickness of the metal walls by which it is constituted decrease, and their mechanical strength is consequently reduced, particularly in the zones of folds 12 and 13.

There is consequently a risk of deformation, as illustrated in FIG. 1(*b*), with the serious result that the contact element is permanently damaged.

In certain arrangements according to the known art, this unbending process is prevented by enclosing the rear portion of the contact element in an insulating housing forming part of the connector body, leaving only a small opening for the insertion of the wire. However, this type of solution makes it costly to produce the body of the connector and, in addition, makes it impossible to dismount the contact element.

FIG. 2 represents a contact element according to the invention. This element, which is supported by an insulating block that is not represented, is designed to receive in its female type front portion 1 a male type pin belonging to another insulating block, not represented. The rear portion 18 is the one that provides the connection with a sheathed wire. It does so by clamping or pinching, acting in the manner described above, with the first side wall 29 comprising a contact, slot 30 providing electrical contact properly speaking, by insulation piercing, and a second side wall 28 comprising an anchoring slot 31, wider than the first slot, anchoring the wire by clamping its insulating sheath and ensuring the strength of the connection to resist tensile forces. Finally, a tab 19, projecting outside the contour of the contact element, enables said element to be attached in the insulating block since the extremity of said tab bears against a complementary part borne by this block.

According to one main feature of the invention, the assembly of the rear portion of the contact element is constituted by a parallelepiped obtained by folding at 20, 21 and 22 the strip 23 forming the prolongation of the front portion of the contact element, the direction of the edges of the parallelepiped is normal to the longitudinal axis of the element.

The strip thus folded into 3 zones, according to angles having the same direction, is in contact with strip 23 along line 24 and, according to the invention, in order to close the parallelepiped mechanically, use is made of a means of attachment between extremity 25 and strip 23, said means taking the form of a tenon 26 capable of penetrating an opening 27, the extremity of the tenon can enter the opening with "soft friction" but a preferred form of embodiment consists, after insertion, of stamping and spreading tenon 26 around opening 27.

Finally, two of the parallel faces 28 and 29 normal to the base strip 23 have piercing and anchoring slots 30 and 31 respectively.

After introducing at least one sheathed wire into the slots, as is customary in the prior art, any accidental tensile force in the direction of arrow 32 is applied to the two walls 28 and 29, which are firmly supported by the other two walls 33 and 34, constituting, with folds 20, 21, 22 and tenon 26, a device that possesses a high degree of mechanical resistance to deformation and unbending in longitudinal direction 32.

FIGS. 3, 4 and 5 represent alternative forms of embodiment of the means for attaching the extremity of the folded strip in the zone 24.

In FIG. 3, two additional tenons, 36 and 37, obtained by cutting out and bending the edge of the strip, reinforce the resistance of the junction to tensile forces in the direction of arrow 32.

In FIG. 4, where the contact is illustrated by a partially cut-away view, the two tenons have been longitudinally extended in the shape of "angle irons" until they occupy a considerable length L on the face of the parallelepiped, it is in this case particularly advantageous to give them a height H such that their extremities 40 bear against the working surface 23 of the parallelepiped, thus ensuring that the right-angles are not deformed.

In FIG. 5, deformation of the angles of the parallelipiped is prevented at the rear face 28 by the addition of side panels 50 and 51 which, by being bent at 52 and 53, come into contact at 54 with the upper face 33 of the parallelepiped, resisting the force applied in the direction of the arrow 32.

FIG. 6 illustrates another form of embodiment of the contact element according to the invention. According to this form of embodiment, the parallelepiped characteristic of the invention is no longer a rectangle, as in the case of the preceding figures, but an oblique, the two opposite parallel faces 61 and 62 comprising the insulation piercing and anchoring slots form an angle P with the main face 34, said angle being less than 90° and having its apex directed towards the closed portion 63 of the slots.

This angular feature is particularly advantageous in that it causes the wire and its sheath to be locked at the bottom of the slot, owing to the effect of the tensile force applied to the wire in the direction of arrow 32, this effect increasing in efficiency the greater the tensile force in question.

This arrangement thus provides the contact element according to the invention with an additional self-locking feature. Angle P can be comprised between 30° and 60°, with a typical value of 45°.

It should be noted that the value of angle P is also advantageous by comparison with a 90° angle in the preceding forms of embodiment, in that the tensile force that is applied to the wire can only have, in a direction normal to the place of the slot bearing surfaces, a lower component, in a proportion equal to the trigonometrical line of the sine of the angle P. The prejudicial force causing any deformation of the rear contact zone is thus reduced in the same proportion.

FIG. 7 illustrates an alternative form of embodiment wherein the acute angle P characterising the oblique parallelepiped is blocked at the selected value by introducing a stop 70 borne on one of the faces of the parallelepiped, said stop fixing the value of the angle desired without there being any possibility of deformation, owing to the fact that its side contour bears at 71 against face 72.

I claim:

1. A contact element having a longitudinal axis, for an insulation piercing type connector for wire covered with an insulating sheath, comprising:

a front member (1) and a rear member (18) disposed in fixed longitudinal relation to said front member, said front member including means for providing contact with a complimentary contact element belonging to another circuit; and said rear member including means for assuring connection with said wire, said rear member comprising a strip, said strip having a first extremity connected to said front member along said longitudinal axis and a second extremity, said strip having three folds, respectively along a first, a second and a third mutually parallel fold line, to form the shape of a parallelepiped, said fold lines being horizontally aligned perpendicular to said longitudinal axis, said strip including a horizontal first planar wall disposed at said first extremity and terminating at said first fold, a second planar wall extending between said first fold and said second fold, a third planar wall extending parallel to said first wall between said second fold and said third fold, and a fourth planar wall disposed at said second extremity and terminating at said third fold and first wall, said second and fourth walls having open slots formed therein for receiving, piercing and connecting said wire, an opening being formed in said strip in one of said first and second extremities, and means for closing said parallelepiped, said closing means comprising a tenon projecting from the extremity other than said one of said extremities and capable of penetrating said opening.

2. Contact element according to claim 1 wherein said closing means further comprises a pair of second tenons, struck from said strip at a chosen one of said first and second extremities, for contacting the extremity other than said chosen one of said first and second extremities.

3. Contact element according to claim 2, wherein said pair of second tenons is struck from said first wall so as to have surfaces facing one of said second and fourth walls such that said tenons comprise a bearing face for one of said second and fourth walls, thus determining the angles of said three folds.

4. Contact element according to claim 1, wherein at least one of the second and fourth walls bears, on its two sides that are not adjacent to the folds, two folded panels at least one edge of which constitutes a bearing face for one of the second and fourth walls, thus determining the angles of the folds.

5. Contact element according to claim 1, wherein at least one of said first and third walls bears, on its two sides that are not adjacent to the folds, two folded panels, at least one edge whereof constitutes a bearing face for one of the transverse walls, thus determining the angles of the three folds.

6. Contact element according to claim 1, wherein the parallelepiped is of the rectangular type.

7. Contact element according to claim 1, wherein the parallelepiped is of the oblique type, the angle of the first fold being comprised between 30° and 60°.

* * * * *